US010662727B2

(12) United States Patent
Nguyen

(10) Patent No.: US 10,662,727 B2
(45) Date of Patent: May 26, 2020

(54) CASING HANGER RUNNING TOOL SYSTEMS AND METHODS

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 301 days.

(21) Appl. No.: 15/391,492

(22) Filed: Dec. 27, 2016

(65) Prior Publication Data

US 2018/0179838 A1 Jun. 28, 2018

(51) Int. Cl.
*E21B 33/04* (2006.01)
*E21B 23/01* (2006.01)

(52) U.S. Cl.
CPC ..... *E21B 23/01* (2013.01); *E21B 33/04* (2013.01)

(58) Field of Classification Search
CPC combination set(s) only.
See application file for complete search history.

(56) References Cited

U.S. PATENT DOCUMENTS

| | | | |
|---|---|---|---|
| 3,926,457 | A | 12/1975 | Williams, Jr. et al. |
| 4,736,799 | A | 4/1988 | Ahlstone |
| 4,836,288 | A | 6/1989 | Wester |
| 5,069,288 | A | 12/1991 | Singeetham |
| 5,249,629 | A | 10/1993 | Jennings |
| 5,372,201 | A | 12/1994 | Milberger |
| 6,823,938 | B1 * | 11/2004 | Milberger ..... E21B 23/01 166/208 |
| 7,231,970 | B2 | 6/2007 | Matusek et al. |
| 8,474,537 | B2 | 7/2013 | Voss et al. |
| 8,973,653 | B2 | 3/2015 | Thornburrow et al. |
| 2005/0133216 | A1 | 6/2005 | Bartlett |
| 2010/0193195 | A1 | 8/2010 | Nguyen et al. |
| 2011/0005774 | A1 | 1/2011 | Sinnoff et al. |
| 2014/0166298 | A1 | 6/2014 | Fenwick |
| 2014/0305631 | A1 | 10/2014 | Schulte et al. |
| 2015/0136394 | A1 | 5/2015 | Turley et al. |
| 2015/0252635 | A1 | 9/2015 | Hartley et al. |
| 2016/0010404 | A1 | 1/2016 | Nguyen et al. |

(Continued)

FOREIGN PATENT DOCUMENTS

| | | | |
|---|---|---|---|
| EP | 2518260 | A1 | 10/2012 |
| GB | 2299104 | A | 9/1996 |

OTHER PUBLICATIONS

U.S. Appl. No. 15/391,501, filed Dec. 27, 2016, Dennis P. Nguyen.

(Continued)

*Primary Examiner* — David J Bagnell
*Assistant Examiner* — Ronald R Runyan
(74) *Attorney, Agent, or Firm* — Fletcher Yoder, P.C.

(57) ABSTRACT

A hanger running tool includes a hanger-contacting segment configured to move radially to engage a corresponding groove formed in a hanger to couple the hanger running tool to the hanger. The tool also includes a piston assembly comprising a first piston configured to couple to a seal assembly. The hanger running tool is configured to run the hanger and the seal assembly simultaneously into a wellhead, and actuation of the first piston is configured to energize the seal assembly to seal an annular space between the hanger and the wellhead.

19 Claims, 9 Drawing Sheets

(56) References Cited

U.S. PATENT DOCUMENTS

| | | | |
|---|---|---|---|
| 2016/0032674 | A1 | 2/2016 | Nguyen et al. |
| 2016/0186502 | A1 | 6/2016 | Nguyen |
| 2016/0265298 | A1 | 9/2016 | Nguyen |
| 2017/0226817 | A1 | 8/2017 | Richards et al. |
| 2018/0258725 | A1 | 9/2018 | Levert, Jr. et al. |

OTHER PUBLICATIONS

PCT International Search Report & Written Opinion for PCT Application No. PCT/US2017/067748 dated Apr. 11, 2018; 14 Pages.

* cited by examiner

CASING HANGER RUNNING TOOL SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead through which the resource is extracted. These wellheads may have wellhead assemblies that include a wide variety of components and/or conduits, such as various casings, hangers, valves, fluid conduits, and the like, that control drilling and/or extraction operations. For example, a long pipe, such as a casing, may be lowered into the earth to enable access to the natural resource. Additional pipes and/or tubes may then be run through the casing to facilitate extraction of the resource.

In some instances, a casing hanger may be provided within the wellhead to support the casing. In some cases, a tool is utilized to facilitate running and lowering a seal into the wellhead to form a seal (e.g. annular seal) between the casing hanger and the wellhead. Some tools may lock the seal in place within the wellhead via rotational movement of the tool. However, rotating tools may increase wear on the wall of the wellhead and/or may increase the duration of the seal locking process.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure include systems and methods having a casing hanger running tool (CHRT) configured to run and set a casing hanger and a seal assembly within a wellhead of a mineral extraction system. In certain embodiments, the CHRT is configured to couple to the casing hanger, and then to lower and set the casing hanger and the seal assembly within the wellhead together by moving (e.g., pushing) the CHRT axially downward into the wellhead. In certain embodiments, the CHRT includes a piston assembly that is configured to drive a lock ring radially outward into a corresponding recess of the wellhead, which sets (e.g., locks) the casing hanger in place within the wellhead. In certain embodiments, the piston assembly is configured to energize the seal assembly to seal an annular space between the casing hanger and the wellhead and to drive a lock ring radially inward into a corresponding recess of the casing hanger to set (e.g., lock) the seal assembly in place between the casing hanger and the wellhead. In some embodiments, the CHRT is configured to run and to set the casing hanger and the seal assembly without rotational movement of any component of the CHRT relative to the wellhead. As set forth above, some existing tools may rotate relative to the wellhead to set seal assemblies in a desired position within the wellhead. The presently disclosed embodiments enable efficient running and setting of the casing hanger and the seal assembly via one trip of the CHRT and via axial movement of the CHRT, as well as provide reduced wear on certain wellhead components (e.g., the casing spool, or the like).

Figure 1:
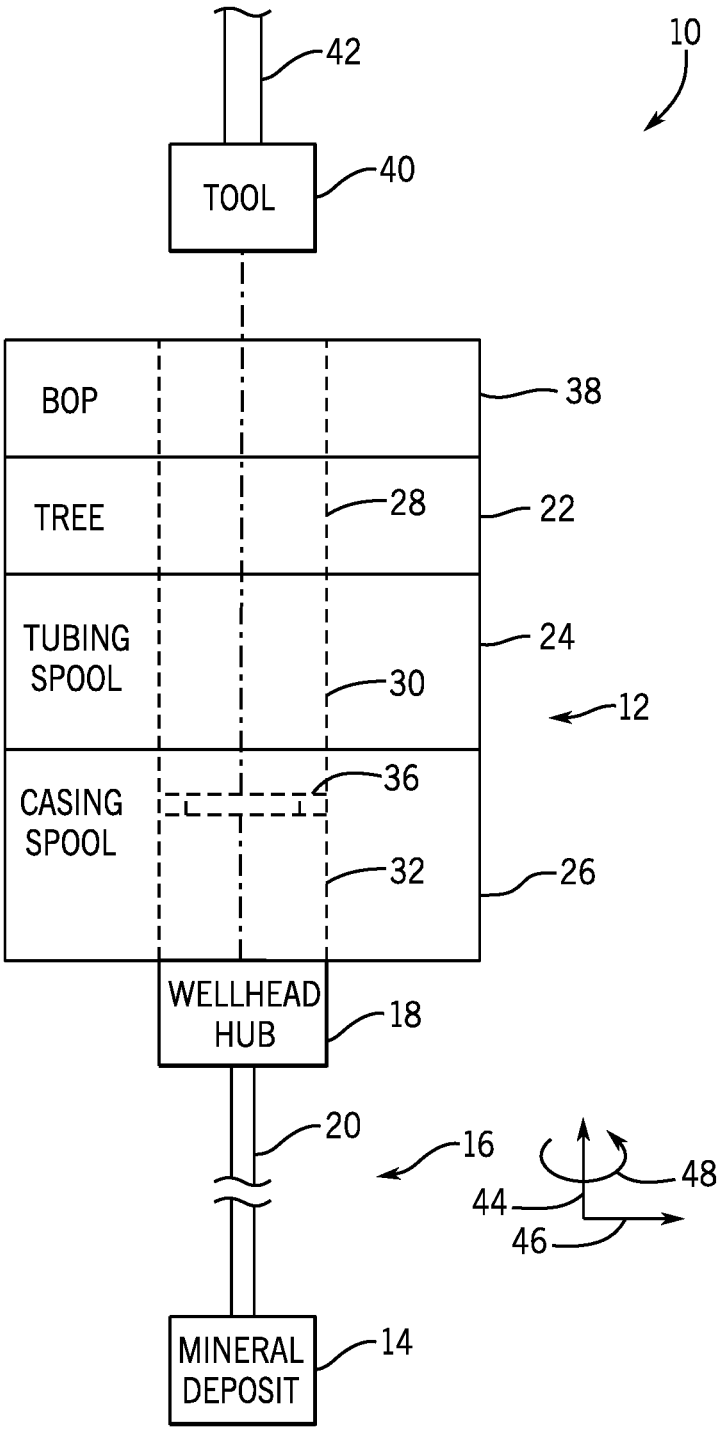
FIG. 1 is a block diagram of a mineral extraction system in accordance with an embodiment of the present disclosure.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and configured to connect the wellhead 12 to the well 16. As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 28 that provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a flowline that is tied back to other components, such as a manifold. Accordingly, produced minerals flow from the well 16 to the manifold via the wellhead 12 and/or the tree 22 before being routed to shipping or storage facilities.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the well bore 20 for various completion and workover procedures. The BOP 38 may consist of a variety of valves, fittings, and controls to prevent oil, gas, or other fluid from exiting the well in the event of an unintentional release of pressure or an overpressure condition.

As shown, a casing hanger 36 is positioned within the casing spool 26. The casing hanger 36 may be configured to support casing (e.g., a casing string) that is suspended in the well bore 20. As discussed in more detail below, one or more seal assemblies may be positioned between the casing hanger 36 and the casing spool 26. In the illustrated embodiment, the system 10 includes a casing hanger running tool (CHRT) 40, suspended from a drill string 42. The CHRT 40 may be configured to be lowered (e.g., run) toward the wellhead 12 (e.g., via a crane or other supporting device). To facilitate discussion, the mineral extraction system 10, and the components therein, may be described with reference to an axial axis or direction 44, a radial axis or direction 46, and a circumferential axis or direction 48.

Figure 2:
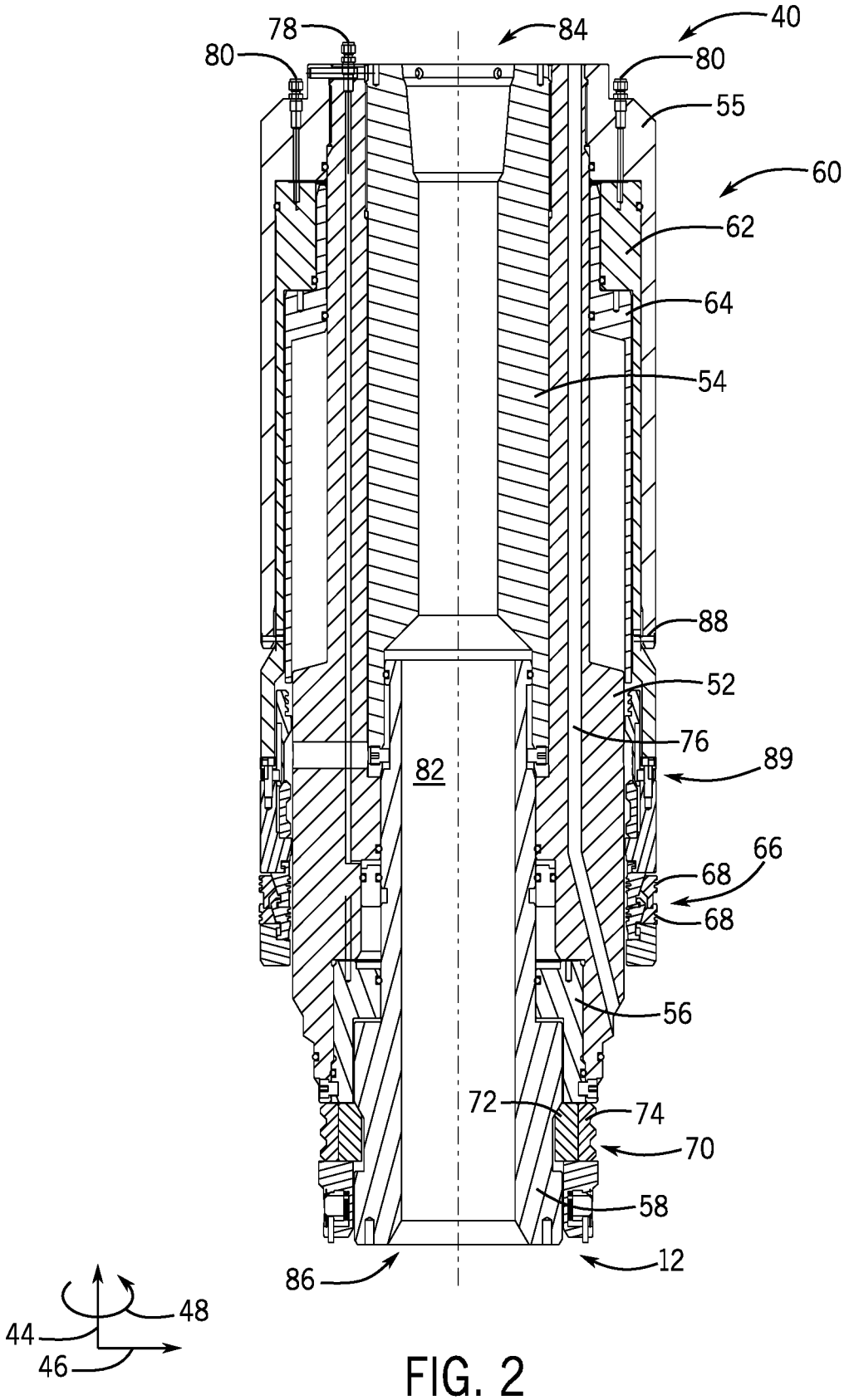
FIG. 2 is a cross-section of an embodiment of a casing hanger running tool (CHRT) that may be utilized to run a casing hanger into a wellhead of the mineral extraction system of FIG. 1.

FIG. 2 is a cross-section of an embodiment of the CHRT 40 that may be utilized to run the casing hanger 36 into the wellhead 12 of the mineral extraction system 10. As shown, the CHRT 40 includes an outer body 52 (e.g., annular body), an inner body 54 (e.g., annular body), an outer sleeve 55 (e.g., annular sleeve), an outer retainer sleeve 56 (e.g., annular sleeve), an inner retainer sleeve 58 (e.g., annular sleeve), a piston assembly 60 (e.g., annular piston assembly) having an outer piston 62 (e.g., annular piston) and an inner piston 64 (e.g., annular piston), a seal assembly 66 (e.g., annular seal assembly) having one or more seals 68 (e.g., annular seals, such as metal annular seals), a hanger-engaging assembly 70 having one or more push segments 72 (e.g., segmented ring or c-shaped ring) and one or more hanger-contacting segments 74 (e.g., segmented ring or c-shaped ring), one or more generally axially-extending fluid channels 76 (e.g., passageway or flow path), one or more first ports 78 (e.g., fluid port), one or more second ports 80, and a central bore 82 that extends from a first end 84 (e.g., proximate end) to a second end 86 (e.g., distal end) of the CHRT 40. In the illustrated embodiment, one or more shear pins 88 extends radially between and couples the outer sleeve 55 to the outer piston 62. In the illustrated embodiment, the seal assembly 60 is suspended from and/or supported by the outer piston 62 via an interface 89 (e.g., a j-slot interface, a key-slot interface, a friction fit, or the like).

Figure 3:
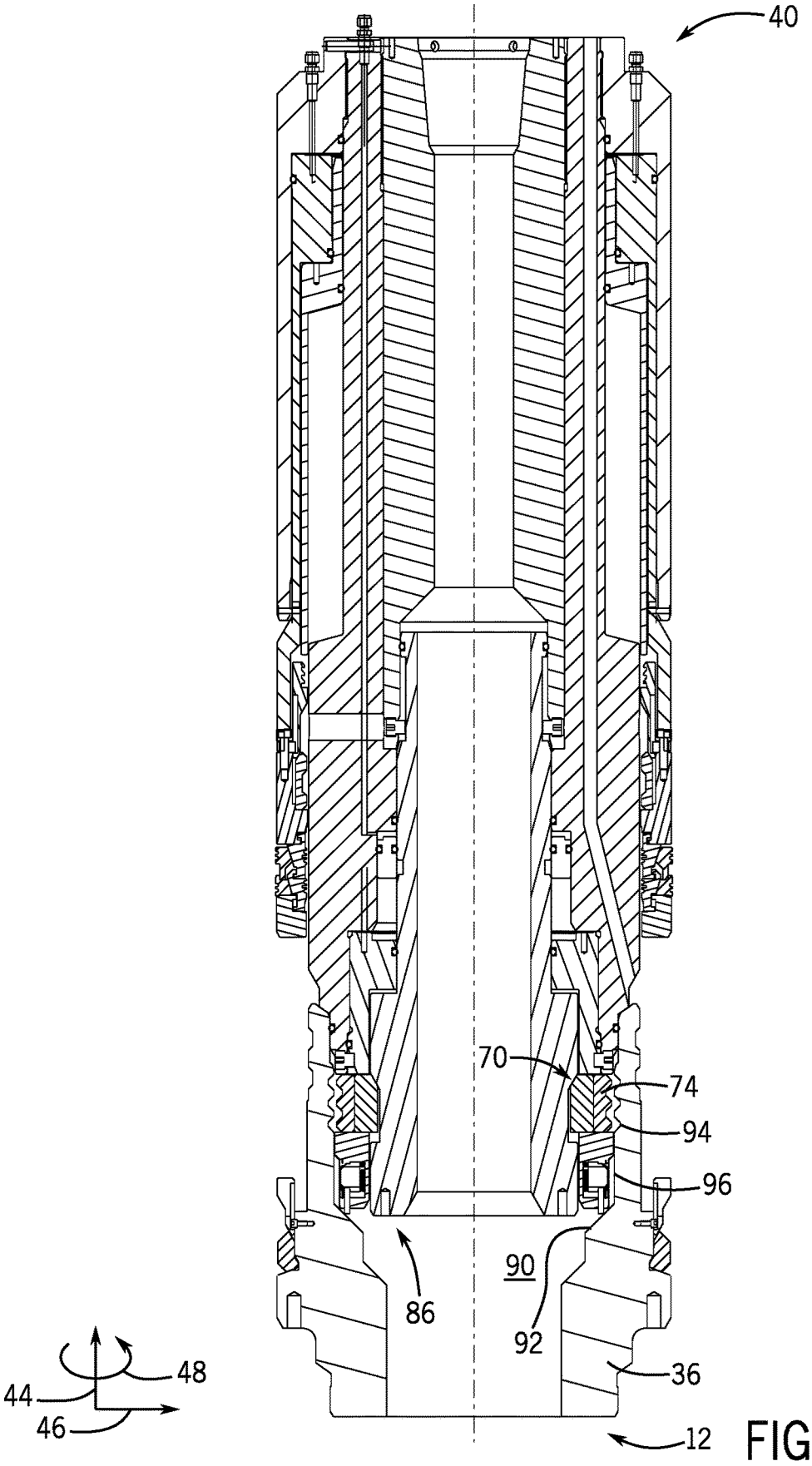
FIG. 3 is a cross-section of the CHRT of FIG. 2 positioned within a bore of the casing hanger.

FIG. 3 is a cross-section of the CHRT 40 positioned within a bore 90 (e.g., central axially-extending bore) of the casing hanger 36. In operation, the CHRT 40 may be lowered into the bore 90 of the casing hanger 36 until the second end 86 (e.g., radially-inwardly-extending and/or axially-facing annular surface, tapered annular surface, conical annular surface) of the CHRT 40 contacts a shoulder 92 (e.g., radially-inwardly-extending and/or axially-facing annular surface, tapered annular surface, conical annular surface) of the casing hanger 36 and/or until the one or more hanger-contacting segments 74 of the hanger-engaging assembly 70 are aligned with corresponding grooves 94 (e.g., circumferentially-extending grooves or annular grooves) in an inner wall 96 (e.g., annular wall) of the casing hanger 36 along the axial axis 44.

Figure 4:
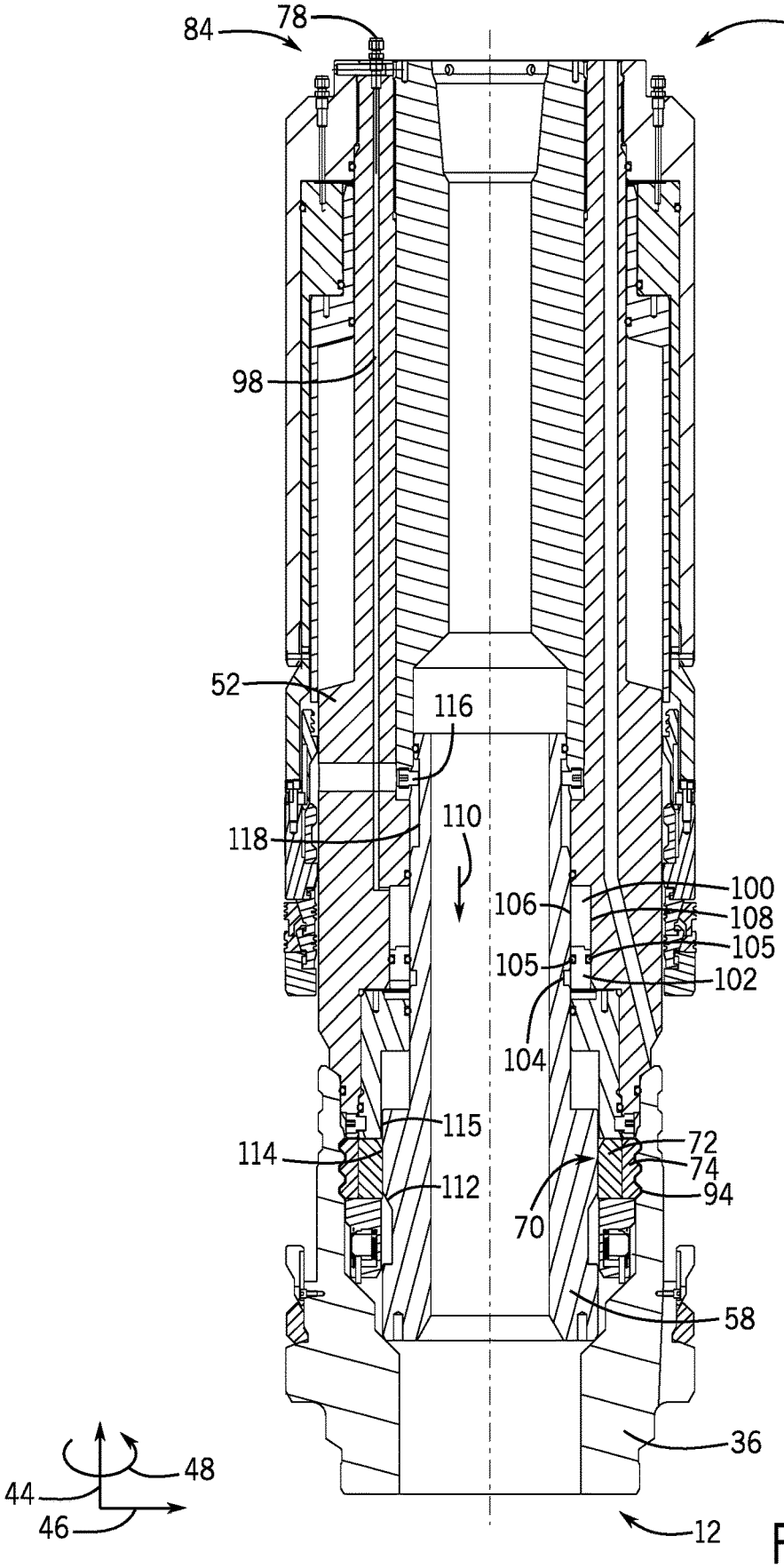
FIG. 4 is a cross-section of the CHRT of FIG. 2 coupled to the casing hanger.

FIG. 4 is a cross-section of the CHRT 40 coupled to the casing hanger 36. In operation, once the hanger-contacting segment 74 of the hanger-engaging assembly 70 is aligned with the corresponding grooves 94 in the inner wall 96 of the casing hanger 36 along the axial axis 44, fluid may be provided via the one or more first ports 78 through one or more corresponding passageways 98 to a space 100 (e.g., annular space). As shown, the first ports 78 are positioned at the first end 84 of the CHRT 40, the passageways 98 are formed in the outer body 52 of the CHRT 40, and the space 100 is defined between the outer body 52 and the inner retainer sleeve 58 of the CHRT 40 along the radial axis 46. In the illustrated embodiment, the inner retainer sleeve 58 includes a piston ring 102 (e.g., annular ring). As shown, the piston ring 102 is coupled to the inner retainer sleeve 58 via one or more fasteners 104, such as threaded fasteners (e.g., screws or bolts); however, the piston ring 102 may be coupled to the inner retainer sleeve 58 via any suitable mechanism or the piston ring 102 and the inner retainer sleeve 58 may be integrally formed (e.g., be a one-piece or unitary structure such that the piston ring 102 and the sleeve 58 are fixed together or not removable). The piston ring 102 may be positioned within the space 100 and may extend between and seal against (e.g., via annular or o-ring seals 105) a radially-outer wall 106 (e.g., annular wall) of the inner retainer sleeve 58 and a radially-inner wall 108 (e.g., annular wall) of the outer body 52 of the CHRT 40.

When the fluid is provided from the one or more first ports 78 through the corresponding one or more passageways 98 to the space 100, the fluid drives the piston ring 102 and the attached inner retainer sleeve 58 to move in an axial direction relative to the outer body 52, as well as relative to the outer retainer sleeve 56 and the hanger-engaging assembly 70 supported therein, from the position shown in FIG. 3 to the position shown in FIG. 4. As the inner retainer sleeve 58 moves, as shown by arrow 110, a tapered outer surface 112 (e.g., tapered annular surface or conical surface) of the inner retainer sleeve 58 moves along a corresponding tapered outer surface 114 (e.g., tapered annular surface or conical surface) of the one or more push segments 72 of the hanger-engaging assembly 70, thereby positioning an axially-extending surface 115 against the one or more push segments 72 to drive and hold the one or more push segments 72 and the one or more hanger-contacting segments 74 radially outwardly to engage the grooves 94 of the casing hanger 36. Thus, the CHRT 40 and the casing hanger 36 may be coupled together via the hanger-engaging assembly 70 (e.g., at the drill floor) and may be subsequently lowered together into the wellhead 12.

As noted above, the one or more push segments 72 and/or the one or more hanger-contacting segments 74 may have any suitable configuration for radially expanding to couple the CHRT 40 to the casing hanger 36. For example, in some embodiments, the one or more push segments 72 and/or the one or more hanger-contacting segments are a c-shaped ring having a first circumferential end and a second circumferential end that define a space (e.g., a gap) at a circumferential location about the ring. Such a configuration enables radial expansion of the push segment 72 and/or radial expansion of the hanger-contacting segments 74 into the corresponding grooves 94, as a distance between the first end and the second end across the space increases in response to the axially downward movement of the inner retainer sleeve 58.

As shown, in some embodiments, one or more stops 116 (e.g., stop segments or an annular stop) may be coupled to the inner body 54 or the outer body 52 and extend radially inwardly into one or more axially-extending cavities 118 (e.g., positioned at discrete locations in the circumferential direction 48 or annular cavity) formed in the radially-outer wall 106 of the inner retainer sleeve 58. The one or more stops 116 and the one or more axially-extending cavities 118 may block or limit axial movement of the inner retainer sleeve 58 relative to body (e.g., the inner body 54 and the outer body 52) of the CHRT 40.

Figure 5:
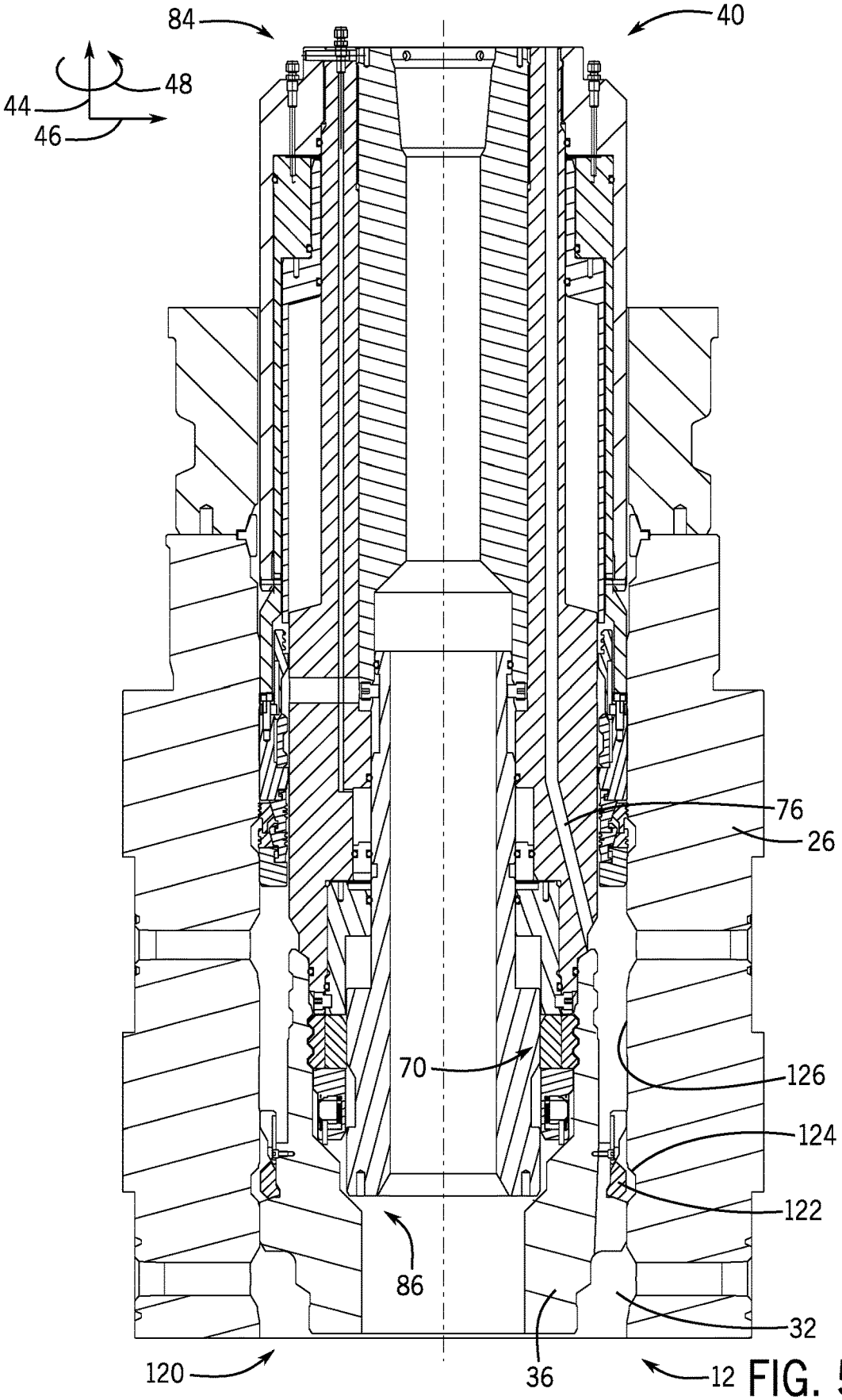
FIG. 5 is a cross-section of the CHRT of FIG. 2 and the casing hanger in a landed position within a bore of a wellhead.

FIG. 5 is a cross-section of the CHRT 40 and the casing hanger 36 in a landed position 120 within the bore 32 of the casing spool 26. As shown, the CHRT 40 and the casing hanger 36 are coupled to one another via the hanger-engaging assembly 70. In the landed position 120, a lock ring 122 (e.g., segmented lock ring or c-shaped lock ring or hanger-to-wellhead lock ring) coupled to the casing hanger 36 may be aligned with a corresponding groove 124 (e.g., annular groove or circumferentially-extending groove) formed in a radially-inner surface 126 of the casing spool 26 along the axial axis 44 and/or the casing hanger 36 may be supported by a shoulder (e.g., radially-inwardly extending surface and/or axially-facing surface) of the casing spool 26. Once the hanger 36 reaches the landed position 120, the hanger 36 may be cemented in place, and cement may flow axially across the CHRT 40 via the one or more axially-extending fluid channels 76. As shown, the channels 76 are formed in the outer body 52. It should be understood that any suitable number (e.g., 1, 2, 3, 4, 5, 6, 7, 8, 9, 10, or more) of channels 76 may be positioned circumferentially about the outer body 52.

Figure 6:
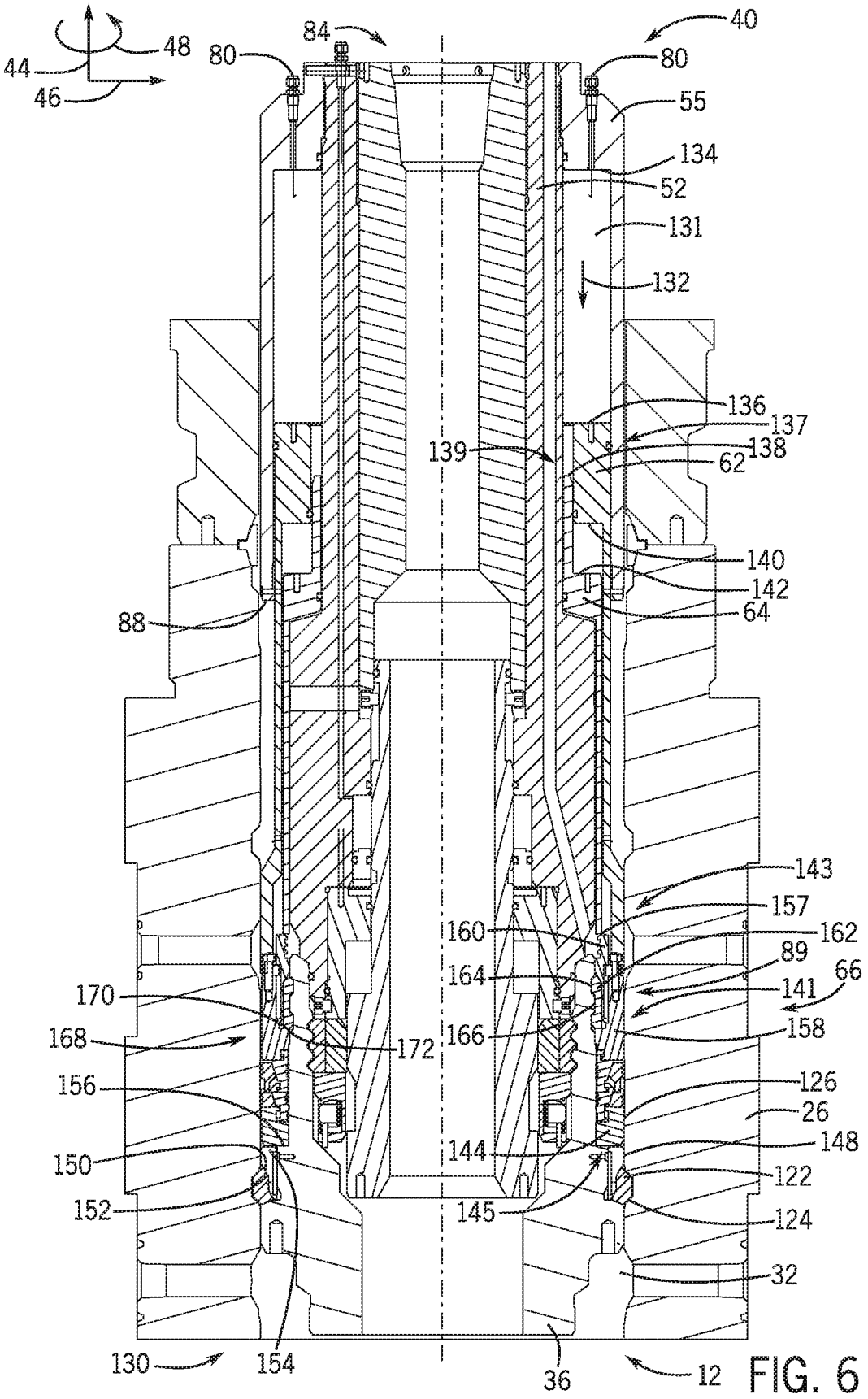
FIG. 6 is a cross-section of the CHRT of FIG. 2 and the casing hanger in a locked position within the bore of the wellhead.

FIG. 6 is a cross-section of the CHRT 40 and the casing hanger 36 in a locked position 130 within the bore 32 of the casing spool 26. In operation, once the CHRT 40 and the casing hanger 36 reach the landed position 120 within the bore 32 of the casing spool 26, fluid may be provided via the one or more second ports 80 into a space 131 (e.g., annular space). As shown, the one or more second ports 80 are positioned at the first end 84 of the CHRT 40 and extend through the outer sleeve 55 of the CHRT 40, and the space 131 is defined between the outer body 52 and the outer sleeve 55 of the CHRT 40 along the radial axis 46, as well as between an axially-facing surface 134 (e.g., annular surface) of the outer sleeve 55 and opposed axially-facing surfaces 136, 138 (e.g., annular surfaces) at respective first ends 137, 139 (e.g., proximal ends) of the outer piston 62 and the inner piston 64 along the axial axis 44.

When the fluid is provided from the one or more second ports 80 to the space 131, the fluid exerts a force on the axially-facing surfaces 136, 138 and drives the outer piston 62 and the inner piston 64 of the piston assembly 60 within the space 131, as shown by arrow 132. Thus, the outer piston 62 and the inner piston 64 move relative to the outer body 52 and the outer sleeve 55, as well as relative to the casing spool 26 and the casing hanger 36. In some embodiments, during an initial portion of the seal installation process, the outer piston 62 and the inner piston 64 may move together, due at least in part to the difference in surface area of the axially-facing surface 136, 138. For example, the axially-facing surface 136 of the outer piston 62 is larger than the axially-facing surface 138 of the inner piston 64 (e.g., at least 10, 20, 30, 40, 50, 60, 70, 80, or 90 percent larger), and thus, the force exerted on the axially-facing surface 136 of the outer piston 62 is larger than the force exerted on the axially-facing surface 138 of the inner piston 64. Accordingly, during the initial portion of the seal installation process, the inner piston 64 may be driven axially, as shown by arrow 132, due primarily to the force exerted on the axially-facing surface 136 of the outer piston 62 and the contact between respective lower axially-facing surfaces 140, 142 of the outer piston 62 and the inner piston 64. As the fluid exerts a force on the axially-facing surfaces 136, 138, the shear pin 88 may break or shear to enable the outer piston 62 and/or the inner piston 64 to move axially relative to the outer sleeve 55, as shown by arrow 132.

As shown, a first axial end 141 (e.g., proximal end) of the seal assembly 66 having the one or more seals 68 is coupled to a second axial end 143 (e.g., distal end) of the piston assembly 60 via the interface 89. In operation, the outer piston 62 may move axially until the casing hanger 36 reaches the locked position 130 in which the lock ring 122 engages the corresponding grooves 124 to block movement (e.g., axial movement) of the casing hanger 36 relative to the casing spool 26. In some embodiments, the axial movement of the outer piston 62 may cause the casing hanger 36 to reach the locked position 130. For example, in some embodiments, axial movement of the outer piston 62 may cause a portion of the seal assembly 66, such as a support element 144 (e.g., support ring) at a second axial end 145 (e.g., distal end) of the seal assembly 66, to contact and to drive a drive ring 148 (e.g., annular drive ring, segmented drive ring, or c-shaped drive ring) axially until the drive ring 148 drives the lock ring 122 radially outwardly to engage the corresponding groove 124 formed in the radially-inner surface 126 of the casing spool 26, thereby locking the casing hanger 36 within the casing spool 26. As shown, the drive ring 148 and the lock ring 122 may have corresponding tapered surfaces 150, 152 (e.g., opposed tapered surfaces) to facilitate axial movement of the drive ring 148 relative to the lock ring 122 and to enable the drive ring 148 to drive and to hold the lock ring 122 within the corresponding groove 124. Furthermore, as shown, the drive ring 148 and the support element 144 of the seal assembly 66 may include opposed axially-facing surfaces 154, 156 to enable the support element 144 to drive the drive ring 148 along the axial axis 44. Additionally, the axial movement of the outer piston 62 compresses and/or energizes the one or more seals 68 between the support element 144 and an energizing ring 158 (e.g., annular energizing ring) of the seal assembly 66.

Once the lock ring 122 reaches the locked position 130, additional fluid is provided to the space 131 (e.g., to increase the pressure within the space 131 and to drive the outer piston 62 and the inner piston 64, as shown by arrow 132) to set the one or more seals 68 and to set a lock ring 162 (e.g., segmented lock ring or c-shaped lock ring or seal-to-casing lock ring). In particular, once the one or more seals 68 are set and energized, the outer piston 62 may be blocked from moving in the direction of arrow 132 (e.g., due to the contact between various structures positioned axially between the lock ring 122 and the outer piston 62). In operation, additional fluid may be provided to the space 131 to drive the inner piston 64 relative to the outer piston 62, as well as relative to other structures, such as the outer body 52, the outer sleeve 55, the casing hanger 36, and the casing spool 26, for example. As the inner piston 64 moves in the direction of arrow 132, a second axial end 157 (e.g., distal end) of the inner piston 64 may contact and drive a drive ring 160 (e.g., annular drive ring, segmented drive ring, or c-shaped drive ring) axially, which in turn drives the lock ring 162 radially-inwardly to engage a corresponding recess 164 formed in a radially-outer wall 166 (e.g., annular wall) of the casing hanger 36, thereby locking the seal assembly 66 in place between the casing hanger 36 and the casing spool 26. As shown, the lock ring 162 is positioned axially above the energizing ring 158, and an interface 168 between opposed surfaces 170, 172 (e.g., axially-facing surfaces) of the lock ring 162 and the energizing ring 158 maintain the casing hanger 36 in the illustrated locked position 130 and the one or more seals 68 in the illustrated energized position.

As noted above, the lock ring 122 may have any suitable configuration for radially expanding to couple the casing hanger 36 to the casing spool 26. Furthermore, the lock ring 162 may have any suitable configuration for radially collapsing to couple the seal assembly 66 to the casing hanger 36. For example, in some embodiments, the lock ring 122 and/or the lock ring 162 are a c-shaped ring having a first circumferential end and a second circumferential end that define a space (e.g., a gap) at a circumferential location about the ring. Such a configuration enables radial movement (e.g., expansion or collapse) of the lock ring 122, 162 as a distance between the first end and the second end across the space changes (e.g., increases or decreases) in response to the axially downward movement of the respective drive ring 148, 160.

Figure 7:
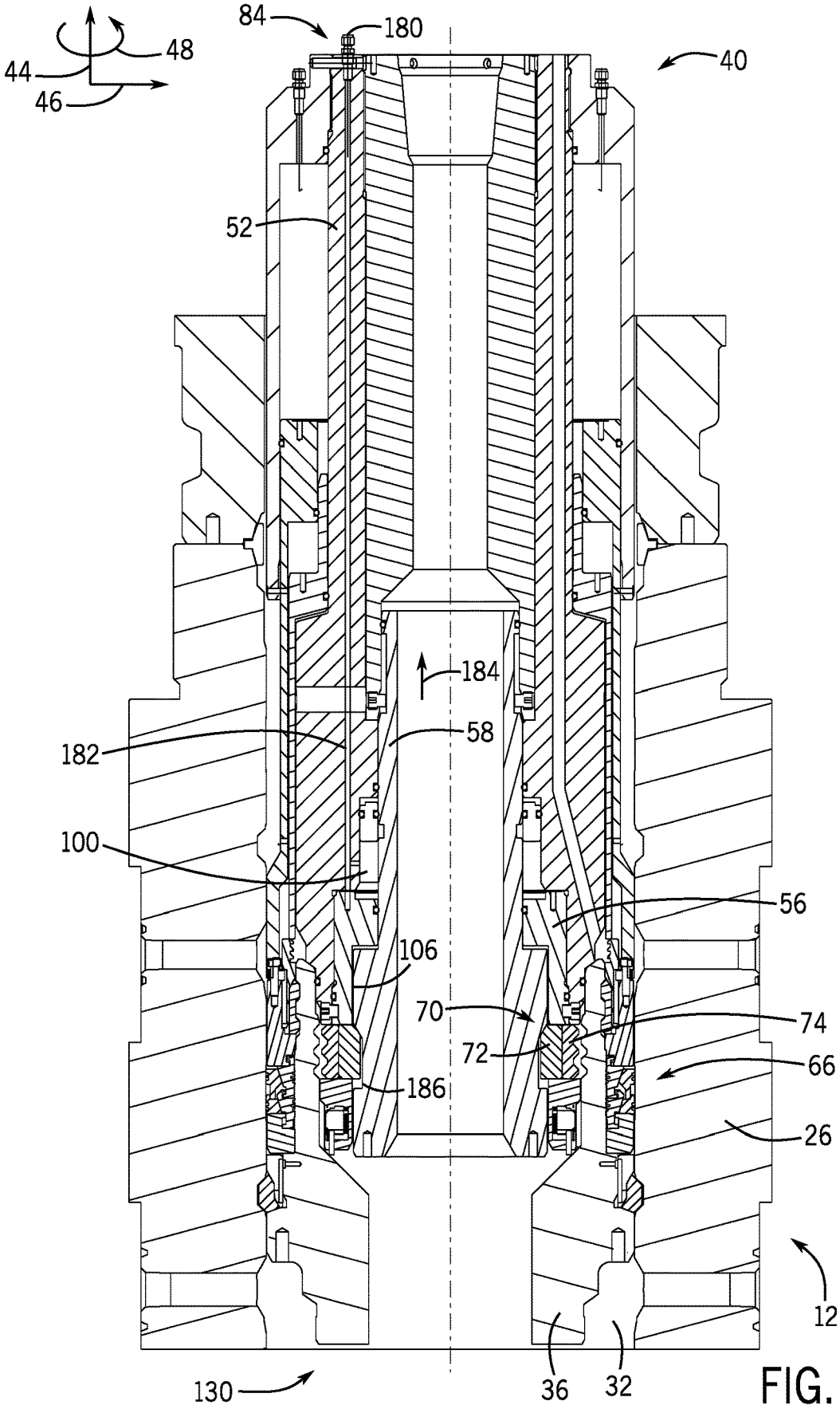
FIG. 7 is a cross-section of the CHRT of FIG. 2 disengaged from the casing hanger that is in the locked position within the bore of the wellhead.

FIG. 7 is a cross-section of the CHRT 40 disengaged from the casing hanger 36, which is in the locked position 130 within the bore 32 of the casing spool 26. In operation, after the casing hanger 36 is locked within the casing spool 26 and the seal assembly 66 is set (e.g., energized and locked) between the casing hanger 36 and the casing spool 26, the CHRT 40 may be disengaged from the casing hanger 36. In some embodiments, the CHRT 40 may be disengaged from the casing hanger 36 by providing fluid via the one or more third ports 180 through one or more corresponding passageways 182 to the space 100 (e.g., annular space). As shown, the one or more third ports 180 are positioned at the first end 84 of the CHRT 40, the passageways 182 are formed in the outer body 52 of the CHRT 40, and the space 100 is defined between the outer body 52 and the inner retainer sleeve 58 of the CHRT 40 along the radial axis 46.

When the fluid is provided from the one or more third ports 180 through the corresponding one or more passageways 182 to the space 100, the fluid drives the piston ring 102 and the attached inner retainer sleeve 58 to move in the axial direction relative to the outer body 52, as well as relative to the outer retainer sleeve 56 and the hanger-engaging assembly 70 supported therein, from the position shown in FIG. 6 to the position shown in FIG. 7. As the inner retainer sleeve 58 moves, as shown by arrow 184, a groove 186 (e.g., annular groove) in the radially-outer wall 106 of the inner retainer sleeve 58 may align with the one or more push segments 72 of the hanger-engaging assembly 70 along the axial axis 44, thereby enabling the one or more push segments 72 and the one or more hanger-contacting segments 74 to move radially inwardly to disengage from the grooves 94 of the casing hanger 36. As noted above, the one or more push segments 72 and the one or more hanger-contacting segments 74 may be segmented rings or c-shaped rings that are biased toward the illustrated retracted (e.g., radially-retracted) position. Thus, the CHRT 40 may be separated from the casing hanger 36 to enable withdrawal of the CHRT 40 from the wellhead 12.

Figure 8:
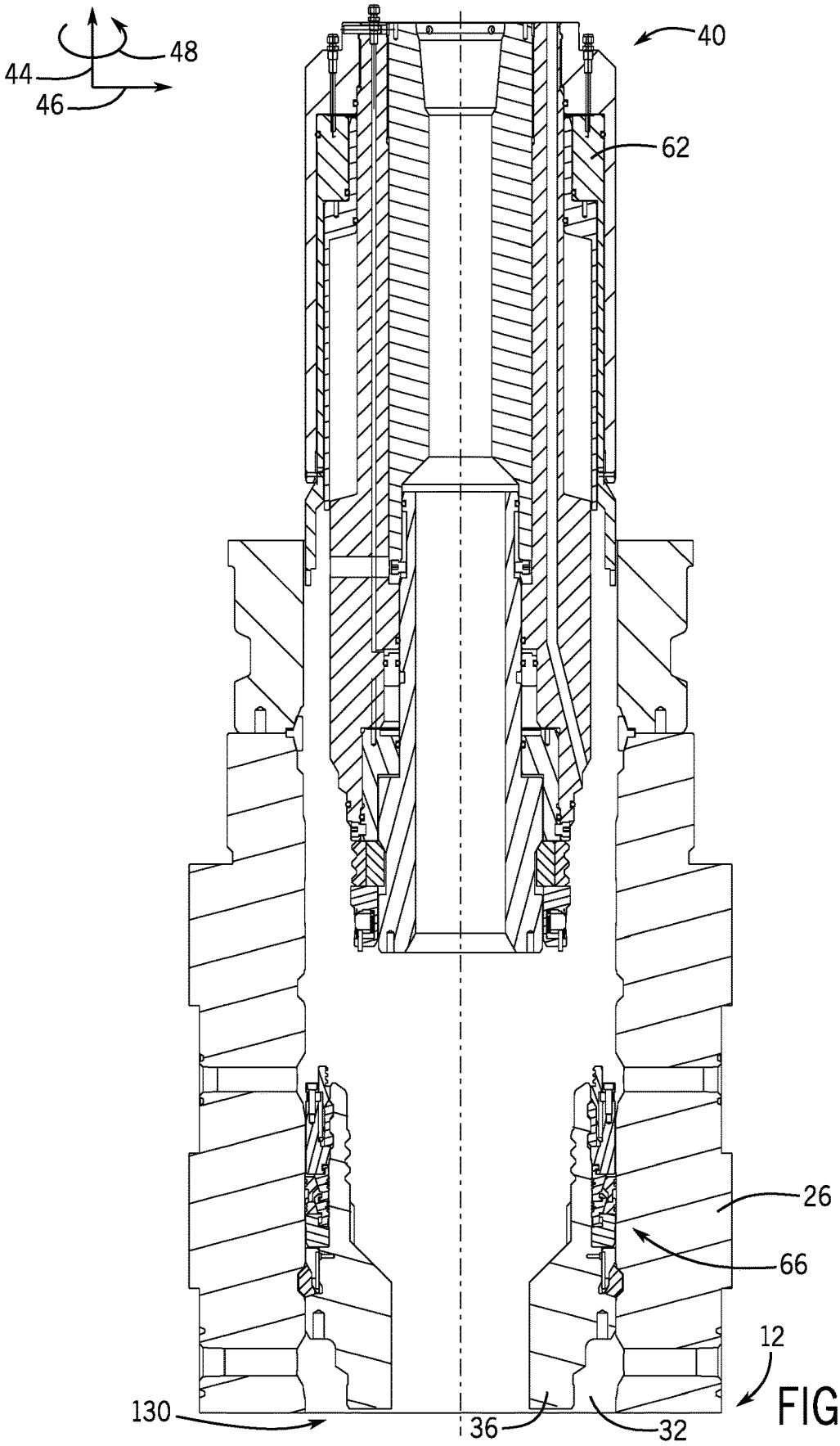
FIG. 8 is a cross-section of the CHRT of FIG. 2 separated from the seal assembly that is set within the bore of the wellhead.

FIG. 8 is a cross-section of the CHRT 40 separated from the seal assembly 66 and the casing hanger 36, which is in the locked positioned 130 within the bore 32 of the casing spool 26. Once the CHRT 40 is disengaged from the casing hanger 36, the CHRT 40 may be separated from the seal assembly 66, such as by disengaging the outer piston 62 of the CHRT 40 from the seal assembly 66 (e.g., by rotating the outer piston 62, such as by a quarter turn, to disengage a pin of the outer piston 62 from a j-slot formed in the seal assembly 66). Once the CHRT 40 is separated from the seal assembly 66, the CHRT 40 may be withdrawn from the wellhead 12 by moving (e.g., pulling) the CHRT 40 in the axial direction 44 (e.g., without rotating the CHRT 40 relative to the wellhead 12).

Figure 9:
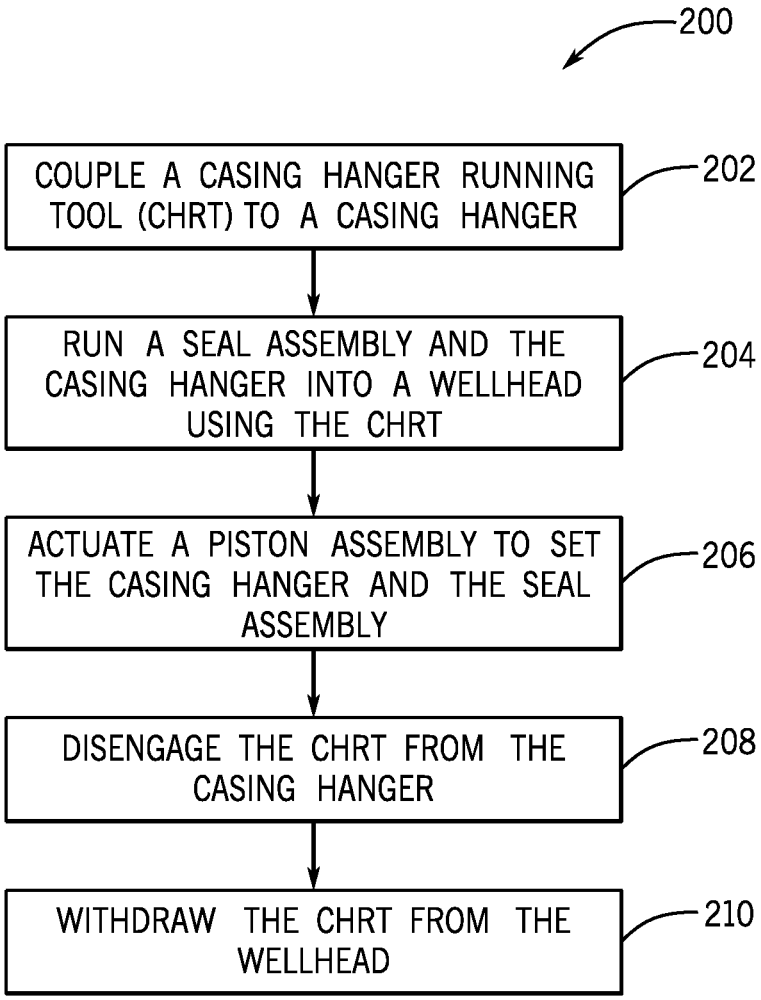
FIG. 9 is a flow diagram of an embodiment of a method for running, setting, and locking a casing hanger within a wellhead using a CHRT.

FIG. 9 is a flow diagram of an embodiment of a method 200 for running, setting, and locking the casing hanger 36 and the seal assembly 66 within the wellhead 12 using the CHRT 40. The method 200 includes various steps represented by blocks. It should be noted that some or all of the steps of the method 200 may be performed as an automated procedure by an automated system and/or some or all of the steps of the method 200 may be performed manually by an operator. Although the flow chart illustrates the steps in a certain sequence, it should be understood that the steps may be performed in any suitable order and certain steps may be carried out simultaneously, where appropriate. Further, certain steps or portions of the method 200 may be omitted and other steps may be added.

The method 200 may begin by coupling the CHRT 40 to the casing hanger 36, in step 202. As discussed above, the CHRT 40 may be coupled to the casing hanger 36 by providing fluid via the one or more first ports 78 to the space 100 to drive the inner retainer sleeve 58, as shown by arrow 110 in FIG. 4, thereby driving the one or more push segments 72 and the one or more hanger-contacting segments 74 radially-outward to engage the corresponding groove 94 of the casing hanger 36.

In step 204, the CHRT 40, with the seal assembly 66 and the casing hanger 36 attached thereto, may be lowered into the wellhead 12. As discussed above, the CHRT 40 may run the seal assembly 66 and the casing hanger 36 into the wellhead 12 (e.g., together, at the same time, simultaneously) until the casing hanger 36 reaches the landed position 120. In step 206, the piston assembly 60 may be actuated to set the casing hanger 36 and the seal assembly 66 within the wellhead 12. As discussed above, once the casing hanger 36 reaches the landed position 120, fluid may be provided via one or more second ports 80 to the space 131 to drive the outer piston 62 and the inner piston 64, as shown by arrow 132 in FIG. 6. The movement of the outer piston 62 and the inner piston 64 may drive the lock ring 122 into the corresponding groove 124, thereby locking the casing hanger 36 to the casing spool 26. The movement of the outer piston 62 may also energize the seal assembly 66, thereby sealing the annular space between the casing hanger 36 and the casing spool 26. Additional fluid into the space 131 may drive the inner piston 64 in the direction of arrow 132, thereby driving the lock ring 162 radially-inward to engage the corresponding recess 164 in the casing hanger 36 to lock the seal assembly 66 in place within the annular space between the casing hanger 36 and the casing spool 26. Thus, the casing hanger 36 and the seal assembly 66 may be run and set via a hydraulic drive system (e.g., the ports 78, 80, 180, the piston ring 102, the piston assembly 60, etc.) in a single trip and without rotation of the CHRT 40 relative to the wellhead 12.

In step 208, the CHRT 40 may disengage from the casing hanger 36. As discussed above, fluid may be provided via the one or more third ports 180 through one or more corresponding passageways 182 to the space 100 to cause the CHRT 40 to disengage from the casing hanger 36. In particular, the fluid may drive the piston ring 102 and the attached inner retainer sleeve 58 in the direction of arrow 184 shown in FIG. 7, thereby enabling the one or more push segments 72 and the one or more hanger-contacting segments 74 to move radially inwardly to disengage from the grooves 94 of the casing hanger 36. In step 210, the CHRT 40 may separate from the seal assembly 66 and may be withdrawn from the wellhead 12, while the casing hanger 36 and the seal assembly 66 remain in the locked position 130 within the wellhead 12. As discussed above, in some embodiments, the CHRT 40 may be separated from the seal assembly 66 by disengaging the outer piston 62 of the CHRT 40 from the seal assembly 66 (e.g., by rotating the outer piston 62, such as by a quarter turn, to disengage a pin of the outer piston 62 from a j-slot formed in the seal assembly 66).

While the embodiments illustrated in FIGS. 1-8 illustrate the lock ring 122 and the drive ring 148 coupled to the casing hanger 36, it should be understood that the lock ring 122 and the drive ring 148 may be coupled to the seal assembly 66 (e.g., the distal end 145 of the seal assembly 66), and thus, may be coupled to the CHRT 40 in FIG. 2 and may be lowered with the seal assembly 66 relative to the casing hanger 36, in the steps illustrated by FIGS. 3-6, for example. Furthermore, while the illustrated embodiments show the casing hanger 36, it should be understood that the CHRT 40 may be adapted to run and to set various annular structures, such as various conduits, pipes, and hangers, including tubing hangers.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A hanger running tool configured to couple to a hanger, comprising:

a piston assembly comprising a first piston configured to couple to a seal assembly, wherein the hanger running tool is configured to run the hanger and the seal assembly simultaneously into a wellhead, and actuation of the first piston is configured to energize the seal assembly to seal an annular space between the hanger and the wellhead and to drive a hanger-to-wellhead lock ring radially-outwardly to engage a corresponding wellhead groove formed in a radially-inner surface of the wellhead to lock the hanger within the wellhead.

2. The hanger running tool of claim 1, wherein the piston assembly comprises a second piston positioned radially-inward of the first piston, and actuation of the second piston is configured to drive a lock ring radially-inwardly to engage a corresponding recess in the hanger to block axial movement of the seal assembly relative to the hanger.

3. The hanger running tool of claim 1, comprising an outer sleeve positioned about the piston assembly and a shear pin extending between the first piston and the outer sleeve, wherein the shear pin is configured to break to enable the first piston to move axially relative to the outer sleeve to facilitate energizing the seal assembly and driving the hanger-to-wellhead lock ring.

4. The hanger running tool of claim 1, comprising a flow slot to facilitate cement flow axially across the hanger running tool.

5. The hanger running tool of claim 1, comprising a hanger-contacting segment configured to move radially to engage a corresponding groove formed in the hanger to couple the hanger running tool to the hanger, and an annular inner retainer sleeve configured to move axially to drive the hanger-contacting segment radially to engage the corresponding groove formed in a surface of the hanger.

6. The hanger running tool of claim 5, comprising one or more first ports configured to provide a fluid to a first annular space to drive the annular inner retainer sleeve axially.

7. The hanger running tool of claim 1, comprising one or more second ports configured to provide a fluid to a second annular space to drive the first piston axially to energize the seal assembly and to drive the hanger-to-wellhead lock ring.

8. The hanger running tool of claim 1, wherein a proximal end of the seal assembly is coupled to the first piston and a distal end of the seal assembly is configured to contact the hanger-to-wellhead lock ring to enable actuation of the first piston to drive the hanger-to-wellhead lock ring.

9. A hanger running tool, comprising:

an outer annular sleeve;

an annular body disposed radially inward of the outer annular sleeve; and a piston assembly comprising an outer piston and an inner piston positioned between the outer annular sleeve and the annular body;

one or more ports configured to provide a fluid to an annular chamber to drive the outer piston and the inner piston to move axially relative to the outer annular sleeve and the annular body;

wherein a first area of a first axially-facing surface of the outer piston exposed to the fluid in the annular chamber is greater than a second area of a second axially-facing surface of the inner piston exposed to the fluid in the annular chamber, and the outer piston and the inner piston are configured to move axially relative to the outer annular sleeve and the annular body to facilitate setting a hanger within a wellhead and to facilitate setting a seal assembly within an annular space between the hanger and the wellhead.

10. The hanger running tool of claim 9, comprising a hanger-contacting segment configured to move radially-outwardly to engage a corresponding groove formed in a radially-inner surface of the hanger to couple the hanger running tool to the hanger to enable the hanger running tool to run the hanger into the wellhead, and an annular inner retainer sleeve configured to move axially to drive the hanger-contacting segment radially-outwardly to engage the corresponding groove.

11. The hanger running tool of claim 9, wherein the one or more ports are configured to provide the fluid to the annular chamber to drive the outer piston and the inner piston to move axially together until the outer piston drives a hanger-to-wellhead lock ring radially-outwardly to engage a corresponding wellhead groove formed in a radially-inner surface of the wellhead to lock the hanger within the wellhead.

12. The hanger running tool of claim 11, wherein the one or more ports are configured to provide the fluid to the annular chamber to drive the inner piston to move axially relative to the outer piston after the outer piston drives the hanger-to-wellhead lock ring radially-outwardly to engage the corresponding wellhead groove formed in the radially-inner surface of the wellhead to lock the hanger within the wellhead to enable the inner piston to drive a lock ring radially-inwardly to engage a corresponding recess in the hanger to set the seal assembly within the annular space.

13. The hanger running tool of claim 9, wherein the outer piston is configured to move axially to energize the seal assembly and to drive a hanger-to-wellhead lock ring radially-outwardly to couple the hanger to the wellhead.

14. The hanger running tool of claim 13, wherein the inner piston is configured to move axially to drive a lock ring radially-inwardly to couple the seal assembly to the hanger.

15. A method, comprising:

coupling a hanger running tool supporting a seal assembly to a hanger;

running the seal assembly and the hanger into a wellhead using the hanger running tool;

driving a first piston of the hanger running tool axially to energize the seal assembly to seal an annular space between the hanger and the wellhead and to drive a hanger-to-wellhead lock ring radially to lock the hanger to the wellhead; and driving a second piston of the hanger running tool axially to drive a lock ring radially to lock the seal assembly in place within the wellhead.

16. The method of claim 15, wherein driving the first piston axially causes a distal end of the seal assembly to contact and to drive the hanger-to-wellhead lock ring radially to lock the hanger to the wellhead.

17. The method of claim 15, wherein coupling the hanger running tool to the hanger comprises driving an annular inner retainer sleeve axially to drive a hanger-contacting segment radially to engage the hanger.

18. The method of claim 15, comprising flowing cement through one or more passageways of the hanger running tool.

19. The method of claim 15, comprising running the hanger and the sealing assembly into the wellhead, energizing the seal assembly, and locking the seal assembly without rotating the hanger running tool.

* * * * *